United States Patent [19]

Bach

[11] Patent Number: 4,703,610

[45] Date of Patent: Nov. 3, 1987

[54] UNITARY TAMPER PROOF CONTAINER

[76] Inventor: Morris Bach, 5 Maria Linda Ct., Hillsborough, Calif. 94010

[21] Appl. No.: 915,121

[22] Filed: Oct. 3, 1986

Related U.S. Application Data

[63] Continuation-in-part of Ser. No. 888,249, Jul. 21, 1986, abandoned.

[51] Int. Cl.[4] ..... B65D 8/02

[52] U.S. Cl. ..... 53/471; 53/485; 215/1 C; 215/2; 215/32

[58] Field of Search ..... 53/452, 471, 478, 477, 53/489, 485; 215/1 C, 2, 32, 31

[56] References Cited

U.S. PATENT DOCUMENTS

| | | | |
|---|---|---|---|
| 1,081,555 | 12/1913 | Russell, Jr. | 215/32 X |
| 3,187,966 | 6/1965 | Klygis | 215/1 C |
| 3,204,835 | 9/1965 | Michel | 215/32 X |
| 4,131,211 | 12/1978 | Corbic | 215/2 |
| 4,281,769 | 8/1981 | Ignell | 215/1 C X |
| 4,572,851 | 2/1986 | Fortuna | 215/1 C X |

FOREIGN PATENT DOCUMENTS

| | | | |
|---|---|---|---|
| 11292 | 5/1980 | European Pat. Off. | 215/2 |
| 1523299 | 3/1968 | France | 215/2 |

*Primary Examiner*—James E. Coan
*Attorney, Agent, or Firm*—Thomas M. Freiburger

[57] ABSTRACT

A tamper proof container for pills, liquid medicines and other substances taken internally is formed of two molded components, fixed together after filling in a secure, permanently sealed bond. The first integrally molded component is an outer shell having a body portion, a neck portion and a closure or cap which may be in an inverted position on top of and closing off the neck portion, all molded together as one component. The second component is a bottom portion having a skirt or sides of substantial depth for fitting tightly in the body portion after filling. The bottom skirt and the body portion are closely fitted together, with a substantial area of contact between them, so that a large area of adhesion or heat bonding is possible, to the extent that the assembled container cannot be broken open without detection. Preferably, the walls of the skirt and the body portion are fully coextensive so that the assembled container appears as one piece. The plastic components may be transparent, permitting visual inspection, and there may be further included frangible low-profile fins on the outside of the outer container wall, to indicate if the container has been subjected to twisting forces as in the grip of a person's hand.

26 Claims, 9 Drawing Figures

UNITARY TAMPER PROOF CONTAINER

BACKGROUND OF THE INVENTION

This application is a continuation-in-part of application Ser. No. 888,249, filed July 21, 1986, now abandoned.

The invention relates to containers, and more particularly a tamper proof container which is closed and permanently sealed immediately after filling, without the use of applied seals.

Contamination of capsules and other internally taken substances after filling and closing of the container by the manufacturer has been a problem. The conventional and usual solution has been to apply a band or tape type seal across the cap and container neck. If someone should later tamper with the container, opening the cap, the seal would be broken and it was hoped that on very careful inspection this could be discovered.

However, this type seal was often inadequate. If great care were taken by a tamperer, an applied seal could be removed and replaced, without detection except by an expert.

Accordingly, there has been a need for a truly tamper proof container which is completely secure and which will readily reveal any tampering which has occurred, even to the most untrained eye, and which will also present a unitary appearance. This is the principal object of the present invention described below.

In the prior art, some previously disclosed containers have included certain of the individual features of the container of the invention as described below, but without the advantages of the invention and without producing a truly tamper proof container. For example, see Italian Pat. No. 657,432 and U.S. Pat. Nos. 3,187,966 and 3,204,835, all showing caps or closures which are integrally molded with some form of container. The caps of these patents were to be broken off, as by the user, and then snapped on, screwed on or forced into the container neck to close the container between uses.

U.S. Pat. No. 4,131,211 related to a bottom closure for a container body formed without a bottom, where the bottom closure was applied after filling.

The prior art did not embrace or suggest the principles of the present invention described below, for producing a unitary tamper proof container which absolutely prevents tampering without detection.

SUMMARY OF THE INVENTION

In accordance with the present invention, a unitary tamper proof container is formed of two assembled components, each of which is itself a single integrally molded component. The first component is an upper portion or outer shell which has a body portion, a neck and a cap or closure, all formed as one in the molding process. The closure preferably is inverted but may be in the upright position just above the neck, and closing the neck, connected to the neck by integral thin plastic material which can be cut or broken by the ultimate consumer. The closure can then be screwed or snapped onto the neck between consumer uses.

The second component of the container is a bottom portion which includes an upwardly extending skirt or walls of such dimension and of sufficient height as to closely slide together with the body portion and provide a large area of tight contact between the bottom skirt and the body portion, for adhesion or heat bonding of the two together over a substantial area, to form a high-integrity permanently bonded seal. In the preferred embodiment the bottom skirt extends inside the body portion and entirely up to the neck, so that the assembled container becomes and appears as a single piece, with no obvious lines of juncture or assembly between the two components.

The second component may include an overlapping annular flange at its bottom, to overlap the bottom end of the body portion, or such a flange can be included on a shoulder of the body portion, to overlap the top of the bottom skirt, if the bottom skirt is on the outside of the body portion as described below.

In the filling of the container with contents, either the bottom portion is filled or the body portion is filled in an inverted position, then the two are pushed together into deep overlapping contact and bonded, as by high-integrity adhesive or by heat sealing. The complete assembled container is thereby completely secure against tampering and possible contamination, since any access to the contents will require either breaking off of the integral cap or destruction of the body of the container, making obvious the tampering.

In a preferred embodiment, the entire container is formed of a substantially transparent plastic material, permitting inspection of the contents without opening. It is preferable that the filled container be marketed without a cover or box, so that the purchaser can examine the container while it is on the shelf.

In a further embodiment, the outer surface of the container optionally includes low-profile frangible fins for further indication of tampering or attempted tampering of the container. The fins are positioned and configured so that any forceful gripping or twisting of the container by a person's hand will fracture portions of the fin, providing indication of attempted tampering. The fins can be included on any of the embodiments described.

Although in the preferred embodiment of the invention the bottom portion of the container is sized to fit and slide inside the body portion, preferably up to the container neck, it can instead fit over the outside of the container body so that the skirt of the bottom portion becomes the external surface of the assembled container body. In this case the first component or upper portion can include a shoulder just below the neck, so that the bottom skirt can be received just under and against the shoulder to produce a substantially flush surface on the outside of the container. Also in this embodiment, the internal body protion preferably extends down to and against the inside surface of the container bottom, again to provide a one-piece appearance.

DESCRIPTION OF PREFERRED EMBODIMENTS

Figure 2:
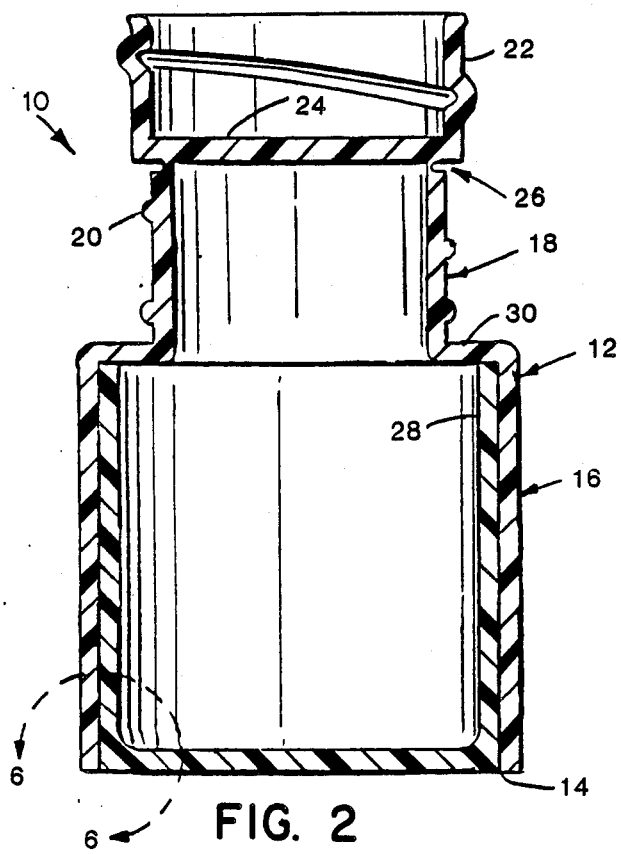
FIG. 2 is a longitudinal sectional view through the container of FIG. 1, as seen along the line in 2—2 in FIG. 1.
Figure 1:
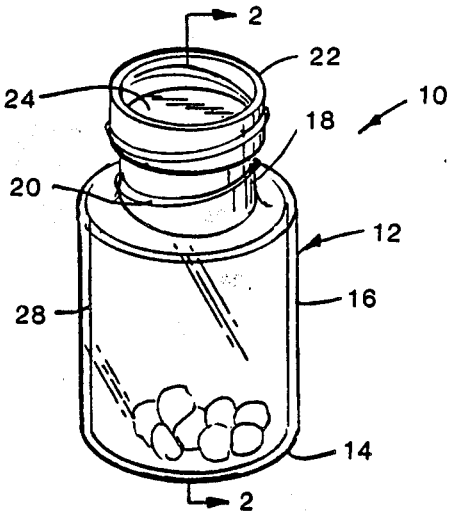
FIG. 1 is a perspective view showing one preferred embodiment of a unitary tamper proof container in accordance with the principles of the invention.

In the drawings, FIGS. 1 and 2 show one embodiment of a unitary tamper proof container 10 in accordance with the principles of the present invention. The container 10, in the assembled form shown in FIG. 1, includes two components: an upper portion or outer shell 12 which is integrally molded as one piece, and a lower or bottom member 14, which preferably extends up into the outer shell 12 as shown in FIGS. 1 and 2 and which is also molded as one piece.

The upper portion or outer shell 12 includes a body portion 16, a neck portion 18 which may be provided with screw threads 20 as shown, and a cap or container closure 22, all formed as a single molded piece. The cap 22, in the embodiment shown in FIGS. 1 and 2, is inverted with respect to the container so that a roof or top panel 24 of the cap is oriented downwardly toward the open, hollow container neck 18 and actually closes the neck in the form as produced, as shown in FIG. 1. A thin web at 26, such as in the form of a thin band as shown in FIG. 2, extends between the cap and the top of the neck portion so as to complete the closure of the neck in this manufactured configuration. This thin plastic 26 is severable by the ultimate consumer as by cutting with a knife, or, if the material is thin enough, by simply applying a forceful twisting to the cap while holding the container body.

Thereafter, the cap is simply turned over to its upright configuration, and it may be screwed onto the threads 20 on the container neck.

Figure 6:
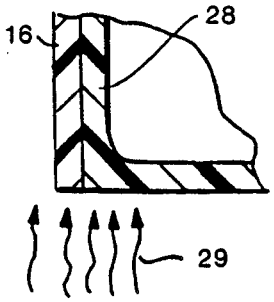
FIG. 6 is a fragmentary detail view in elevational section showing a joint at the bottom of the assembled container being heated to fuse two layers of plastic together.

The assembled container as shown in FIGS. 1 and 2 is of such dimensions that the body portion of the outer shell fits very closely over the outside of an upwardly extending skirt portion 28 of the bottom member. This is partially shown by dashed lines in FIG. 1. The bottom skirt portion 28 extends a substantial distance up the inside of the body portion, at least half way, and preferably up to and against a shoulder 30 just below the neck, so that there is a very large area of close contact between the two plastic walls. This provides an opportunity for a high-integrity sealed and permanently fixed connection between the two, which can be accomplished by a high integrity plastic adhesive, or by heat sealing (such as by ultrasonic bonding). In this way, the two components are so securely and permanently affixed together that they cannot be separated without destruction of the container, making obvious the tampering attempt. Further, the skirt portion 28 in the preferred embodiment abuts against the bottom surface of the shoulder 30 to partially conceal the juncture of the two components at that location and to give the appearance and the structural characteristics of a one-piece container. At the bottom (as shown in FIG. 2) the two components are preferably flush or nearly flush, further making the assembled container appear unitary. With this bottom edge juncture configuration the assembled container may be put through a further step of heat application to the bottom periphery to actually fuse the two plastic layers together at that location. FIG. 6 shows heat being applied (arrows 29) to fuse the layers 16 and 28 into one contiguous mass around this annulus at the bottom.

The cap cannot be removed without an obvious showing that this "seal" has been broken, so that any consumer or layman can see that the container has been tampered with subsequent to its leaving the assembly process at the point of filling and assembly.

The tamper proof container of the invention therefore avoids the need for any applied seals such as have conventionally been used across the cap and neck in prior attempts to prevent undetected tampering. These prior applied seals have typically comprised flexible band or tape-like seals adhered to the cap and neck.

Figure 3:
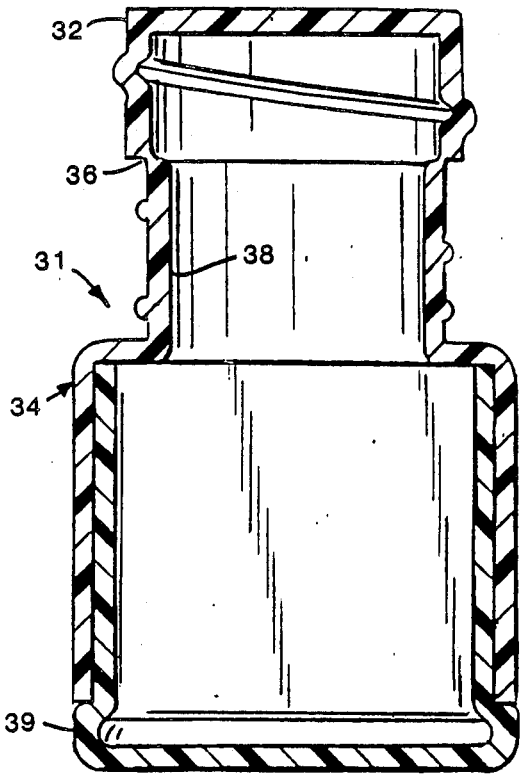
FIG. 3 is a similar sectional view showing another embodiment of the invention, with the closure or cap molded in a different position from FIG. 1.

FIG. 3 shows in cross sectional view another form 31 of the invention, wherein the container closure or cap 32 is integrally formed as part of an outer shell 34, but with the cap in an upright position rather than inverted as in FIG. 1. Although this presents more difficultly in molding of the outer shell, such molding may generally be accomplished with certain types of blow molding. As shown in FIG. 3, thin plastic material 36 secures the bottom edge of the closure 32 to the top edge of the threaded neck 38.

FIG. 3 also shows the container 31 in a square or rectangular configuration except for the neck 38 and the cap 32. The container can take almost any shape in accordance with the general principles of the invention, so long as it permits a sliding together assembly of an outer shell and a bottom portion as illustrated.

As also shown in FIG. 3, the container bottom portion may include an outwardly extending hip 39 at the bottom periphery to form an essentially flush outer surface between the lower part of the outer shell 34 and the hip 38 in the assembled container.

Figure 4:
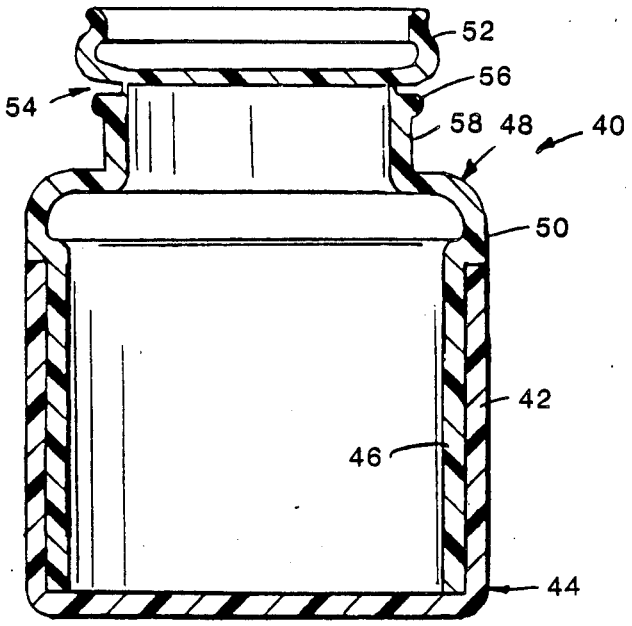
FIG. 4 is a view showing a further embodiment of the invention having some modifications, including a different overlapping relationship between a bottom component and an upper component, and also with a different type of closure from that of FIG. 1.

FIG. 4 illustrates several alternate forms of the invention, in an assembled container 40. In FIG. 4, the skirt 42 of the bottom portion 44 of the container is positioned in overlapping relationship over the outside surface of a body portion 46 of an upper component generally identified at 48. In this form of the invention there preferably is included a shoulder 50 on the upper component or outer shell 48, of diameter or outer dimension slightly larger than that of the body portion 46 which contacts the bottom skirt 42, in order to present a substantially flush surface at the exterior of the container. Again, the container may be generally cylindrical, square, rectangular or any other desired general shape.

In this embodiment the upper component 48 is filled in inverted position prior to assembly of the container.

As can be envisioned from FIG. 4, the overlap of the bottom skirt over the body portion still affords a large area of tight contact between the skirt 42 and the body portion 46, so that the two may be adhered in permanently sealed relationship upon assembly with contents inside. In this embodiment the upper component 48 generally will be inverted to receive the contents, prior to application of the bottom portion 44.

Another variation illustrated in FIG. 4 is that the closure or cap 52 may be of the snap-on type, rather than a screw-on closure as illustrated above. Other forms of closure engagement may also be employed. In FIG. 4 the closure 52 is in inverted position, with a thin portion of integral plastic 54 sealing the two together until cut or broken by the consumer.

The plastic material of the outer shell 48 of the embodiment shown in FIG. 4, and preferably also of the bottom portion 44, is of a yieldable type which will permit the cap or closure 52 to yield slightly in order to snap over a boss or ring 56 of a neck portion 58. The closure 52 (or 22 or 32, above) may be a child-proof closure if desired, or a type within the limitations of molding the upper component as one integral piece.

It should be understood that the closure type illustrated in FIG. 4 can be used on any of the illustrated embodiments.

Figure 5:
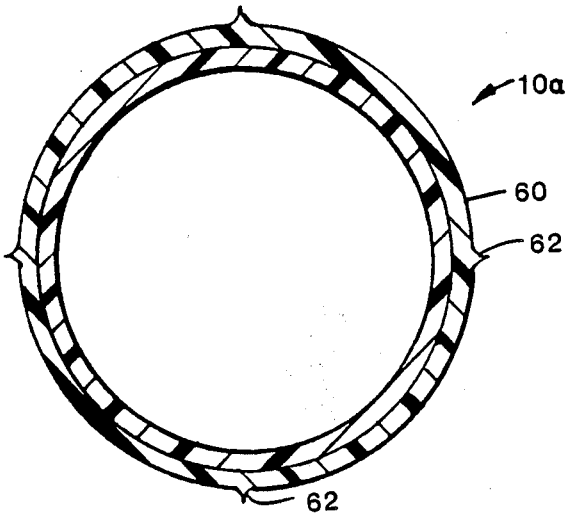
FIG. 5 is a plan section view showing the inclusion of fins on the exterior surface of the assembled container, for indicating tampering if the container is forceably gripped.

In FIG. 5 is illustrated a container 10*a*, similar to the container 10 of FIG. 1, in plan sectional view. The outer wall 60 of the container 10*a*, whether it be the outer surface of the outer shell or of the bottom portion, has integrally molded on its surface one or more frangible fins 62, extending generally vertically on the outer surface 60 to provide further indication of tampering or attempted tampering. The frangible fins 62 will fracture in area where they are gripped tightly by a hand in a twisting motion. Thus, if someone attempts to open the container with a forceful gripping, at least portions of the fins 62 will reveal this. The fins 62 may be included on any of the embodiments of the invention illustrated and described herein.

Figure 7:
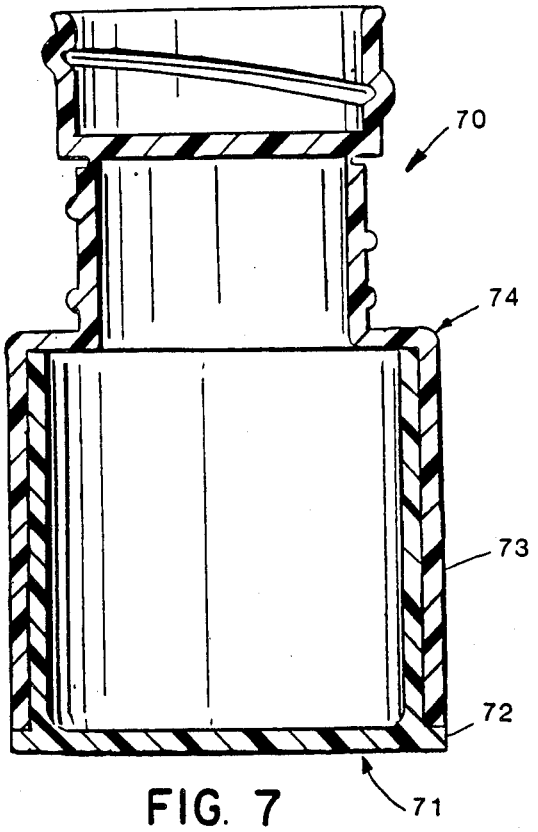
FIG. 7 is a view similar to FIG. 2, but showing a variation in the construction of the container.
Figure 8:
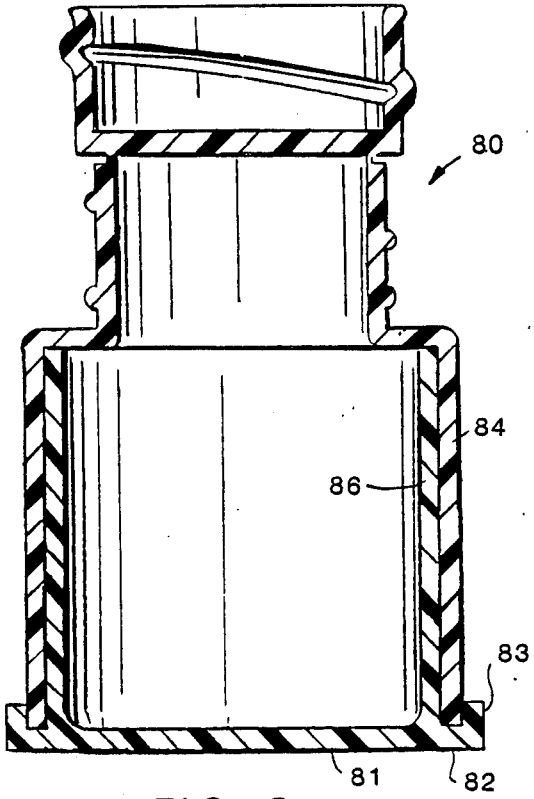
FIG. 8 is another view similar to FIG. 2, showing another variation in construction.
Figure 9:
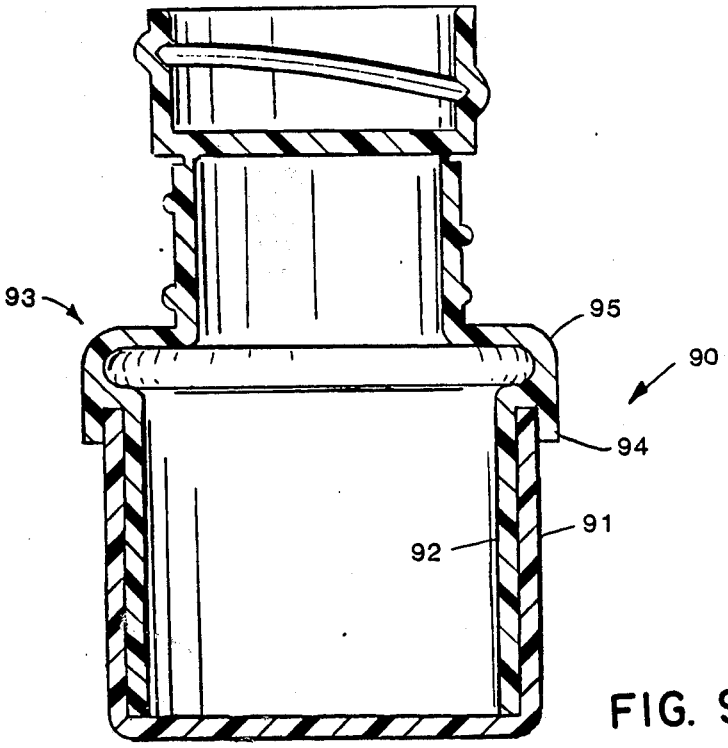
FIG. 9 is a view similar to FIG. 4, showing a variation in construction to that embodiment.

FIGS. 7, 8 and 9 show variations to the tamper proof containers shown in FIGS. 2 and 4. In FIG. 7 a container 70 has a bottom member 71 similar to that of FIG. 2, but with an annular flange 72 extending radially outwardly by a distance substantially the same as the thickness of the container's body portion 73 of an upper component 74. The bottom edge of the body portion 73, upon assembly, rests against (or in very close proximity to) the annular flange 72. This construction provides additional security against tampering, being generally similar in concept to the configuartion shown in FIG. 3.

In FIG. 8 a tamper proof container 80 has a bottom member 81 with an annular flange 82 and also a lip 83 extending upwardly from the flange, so positioned as to form an annular channel to closely receive the bottom edge of the body portion 84 between the lip 83 and the exterior of the skirt portion 86 of the bottom member. This provides still further security against tampering, as by attempted insertion of a knife, and also provides additional area for gluing of the two components.

FIG. 9 shows a modification similar to that of FIG. 8, but on a tamper proof container 90 similar to that of FIG. 4, i.e. with a bottom skirt 91 which extends over the outside of the body portion 92 of an upper component 93. In this embodiment there is an overlap of the top edge of the skirt 91 by a lip 94 extending down from the shoulder 95 of the upper component 93. Thus, the upper edge of the skirt 91 is closely received between the lip 94 and the exterior of the body portion 92. In this way, additional security against tampering is provided in this embodiment wherein the bottom member skirt extends over the outside of the body portion of the upper component.

As discussed above, the tamper proof containers in accordance with the invention preferably are transparent, for additional verification of the integrity of the contents by visual inspection. This permits the manufacturer to inspect the product before it leaves the plant, as well as giving the consumer the opportunity to inspect the product on the shelf.

The above described preferred embodiments are intended to illustrate the principles of the invention, but not to be limiting of the scope of the invention. Other embodiments and variations to these illustrated embodiments will be apparent to those skilled in the art and may be made without departing from the scope of the invention as defined in the following claims.

I claim:

1. A unitary tamper proof container, for maintaining security of the contents of the container without applied seals, comprising:

a hollow upper component or outer shell having an open-bottomed body portion, a neck portion and a container closure all integrally molded of a single piece of plastic material, the container closure being integrally connected in sealed relationship to the top of the neck portion, so as to close the hollow neck portion, by integral thin plastic material severable by a consumer so as to separate the container closure from the neck portion, a bottom member of plastic material having a bottom panel providing a bottom for the container and an upwardly extending skirt portion in coextending contact with the body portion and closing the open bottom of the body portion, with the skirt portion being for a substantial height in sealed, permanently affixed contact with the body portion to sealingly retain contents within the container without possibility of undetected tampering, the bottom member skirt being of approximately the same outside dimension as the inside dimension of the body portion of the outer shell, and the skirt being of such length as to extend substantially from the container bottom at least half way up inside the body portion, providing a large area of contact between the bottom skirt and the body portion, with adhesion means permanently affixing the skirt and the body portion together at said large area of contact, and the container closure and neck portion having cooperating elements for enabling securing of the closure on the container by the consumer after separation of the closure from the neck portion.

2. The container of claim 1, further including at least one frangible fin extending generally radially outwardly from the outside of the body portion, the fin being of low profile with respect to the container and being positioned to break if substantial force is applied to the outside of the container by the grip of a person's hand.

3. The container of claim 1, wherein the hollow outer shell and the bottom member are substantially transparent, aiding in visual inspection of the contents.

4. The container of claim 1, wherein the adhesion means comprises heat sealing of the skirt to the body portion.

5. The container of claim 1, wherein the adhesion means comprises a permanent adhesive in contact with the skirt and the body portion.

6. The container of claim 1, wherein the skirt extends substantially through the height of the body portion and up to the bottom of the neck portion.

7. The container of claim 6, wherein the hollow upper component includes an internal shoulder just below the neck portion, and wherein the skirt of the bottom member extends up to and abuts against the internal shoulder, substantially obscuring the juncture of the upper component and the skirt at this location.

8. The container of claim 7, wherein the body portion of the upper component extends down to the level of the bottom surface of the bottom member, so that a bottom surface of the assembled container has a substantially flush area of juncture of the bottom member and the bottom edge of the body portion.

9. The container of claim 8, wherein the bottom member and the bottom edge of the body portion are heat-fused together in said flush area of juncture.

10. The container of claim 6, wherein the bottom member includes an annular flange extending generally radially outwardly and generally flush with the bottom surface of the bottom member, and wherein the body portion of the upper component extends down to and substantially into contact with the upper surface of the annular flange.

11. The container of claim 6, wherein the bottom member includes an annular flange extending generally radially outwardly and generally flush with the bottom surface of the bottom member and terminating in an upwardly extending annular lip forming an annular channel between the lip and the outer surface of the bottom member skirt, with the body portion of the upper component extending down into and being closely received in the annular channel.

12. The container of claim 1, wherein the bottom member includes an annular flange extending generally radially outwardly and generally flush with the bottom surface of the bottom member, and wherein the body portion of the upper component extends down to and substantially into contact with the upper surface of the annular flange.

13. The container of claim 1, wherein the bottom member includes an annular flange extending generally radially outwardly and generally flush with the bottom surface of the bottom member and terminating in an upwardly extending annular lip forming an annular channel between the lip and the outer surface of the bottom member skirt, with the body portion of the upper component extending down into and being closely received in the annular channel.

14. A unitary tamper proof container, for maintaining security of the contents of the container without applied seals, comprising:

a hollow upper component or outer shell having an open-bottomed body portion, a neck portion and a container closure all integrally molded of a single piece of plastic material, the container closure being integrally connected in sealed relationship to the top of the neck portion, so as to close the hollow neck portion, by integral thin plastic material severable by a consumer so as to separate the container closure from the neck portion, a bottom member of plastic material having an upwardly extending skirt portion in coextending contact with the body portion and closing the open bottom of the body portion, with the skirt portion being for a substantial height in sealed, permanently affixed contact with the body portion to sealingly retain contents within the container without possibility of undetected tampering, the skirt portion of the bottom member extending over the outside of and at least half way up the height of the body portion, and the container closure and neck portion having cooperating elements for enabling securing of the closure on the container by the consumer after separation of the closure from the neck portion.

15. The container of claim 14, including at least one frangible fin extending generally radially outwardly from the outside of the skirt portion, the fin being of low profile with respect to the container and being positioned to break if substantial force is applied to the outside of the container by the grip of a person's hand.

16. The container of claim 14, wherein the body portion of the outer shell includes an outwardly extending shoulder below the neck portion, and wherein the skirt portion of the bottom member extends to and substantially abuts against the shoulder, so that the shoulder and skirt portion are substantially flush on the assembled container.

17. The container of claim 16, wherein the outwardly extending shoulder includes an annular outer lip extending downwardly in parallel relationship to an outer wall of the body portion, forming an annular channel open at its lower side, and wherein the skirt portion of the bottom member extends into and is closely received within the annular channel.

18. The container of claim 16, wherein both the hollow outer shell and the bottom member are substantially transparent, aiding in visual inspection of the contents.

19. The container of claim 16, wherein the body portion of the upper component has a lower edge which abuts against the horizontal inside surface of the bottom member.

20. A method for producing, filling and sealing a unitary tamper proof container without applied seals, comprising:

producing as an integrally molded structure a hollow upper component having an open-bottomed body portion, a neck portion and a container closure all integrally molded of a single piece of plastic material, the container closure being integrally connected in sealed relationship to the top of the neck portion, so as to close the hollow neck portion, by thin plastic material severable by a consumer so as to separate the container closure from the neck portion, the container closure and neck portion having cooperating elements for enabling securing of the closure on the container by the consumer after separation of the closure from the neck portion, producing a bottom member of plastic material, with an upwardly extending skirt portion dimensioned so as to allow the body portion of the upper component to slip together with the skirt portion in overlapping relationship, adding the desired contents to the container, either by filling the bottom member with the contents or by filling the upper component in inverted position with the contents, slipping the bottom member together with the upper component with close, overlapping contact between the skirt portion and the body portion through a substantial height of the body portion so that the skirt portion extends at least half way up inside the body portion, to thereby retain the contents inside the container, and affixing the body portion and skirt portion together in sealed, permanent contact generally through the height of the overlapping portion, so that the contents are retained within the container without possibility of subsequent tampering without detection.

21. The method of claim 20, wherein the skirt extends inside the body portion and including assembling the upper component and the bottom member so as to bring the body portion of the upper component down to the level of the bottom surface of the bottom member, producing a substantially flush area of juncture of the bottom member and the bottom edge of the body portion.

22. The method of claim 21, further including heat-fusing the bottom member and the bottom edge of the body portion together after filling and assembly, to form an integral mass of material where the bottom edge of the body portion meets the bottom member.

23. The method of claim 20, wherein both the hollow upper component and the bottom member are substantially transparent, aiding in visual inspection of the contents.

24. The method of claim 20, wherein the skirt extends inside the body portion and wherein the bottom member includes an annular flange extending generally radially outwardly and generally flush with the bottom surface of the bottom member, and wherein the body portion of the upper component extends down to and substantially into contact with the upper surface of the annular flange.

25. A method for producing, filling and sealing a unitary tamper proof container without applied seals, comprising:

producing as an integrally molded structure a hollow upper component having an open-bottomed body portion, a neck portion and a container closure all integrally molded of a single piece of plastic material, the container closure being integrally connected in sealed relationship to the top of the neck portion, so as to close the hollow neck portion, by thin plastic material severable by a consumer so as to separate the container closure from the neck portion, the container closure and neck portion having cooperating elements for enabling securing of the closure on the container by the consumer after separation of the closure from the neck portion, producing a bottom member of plastic material, with an upwardly extending skirt portion dimensioned so as to allow the body portion of the upper component to slip together with the skirt portion in overlapping relationship, adding the desired contents to the container, by filling the bottom member with the contents, slipping the bottom member together with the upper component with close, overlapping contact between the skirt portion and the body portion through a substantial height of the body portion to thereby retain the contents inside the container, with the skirt extending inside the body portion, and the hollow upper component includeing an internal shoulder just below the neck portion, and with the skirt of the bottom member extending up to and abutting against the internal shoulder, substantially obscuring the juncture of the upper component and the skirt at this location, and affixing the body portion and skirt portion together in sealed, permanent contact through the overlapping portion, so that the contents are retained within the container without possibility of subsequent tampering without detection.

26. A method for producing, filling and sealing a unitary tamper proof container without applied seals, comprising:

producing as an integrally molded structure a hollow upper component having an open-bottomed body portion, a neck portion and a container closure all integrally molded of a single piece of plastic material, the container closure being integrally connnected in sealed relationship to the top of the neck portion, so as to close the hollow neck portion, by thin plastic material severable by a consumer so as to separate the container closure from the neck portion, the container closure and neck portion having cooperating elements for enabling securing of the closure on the container by the consumer after separation of the closure from the neck portion, producing a bottom member of plastic material, with an upwardly extending skirt portion dimensioned so as to allow the body portion of the upper component to slip together with the skirt portion in overlapping relationship, adding the desired contents to the container, either by filling the bottom member with the contents or by filling the upper component in inverted position with the contents, slipping the bottom member together with the upper component with close, overlapping contact between the skirt portion and the body portion through a substantial height of the body portion to thereby retain the contents inside the container, the skirt extending inside the body portion and the bottom member includeing an annular flange extending generally radially outwardly and generally flush with the bottom surface of the bottom member and terminating in an upwardly extending annular lip forming an annular channel between the lip and the outer surface of the bottom member skirt, with the body portion of the upper component extending down into and being closely received in the annular channel, and affixing the body portion and skirt portion together in sealed, permanent contact through the overlapping portion, so that the contents are retained within the container without possibility of subsequent tampering without detection.

* * * * *